United States Patent [19]

Felger et al.

[11] 4,440,131

[45] Apr. 3, 1984

[54] REGULATING DEVICE FOR A FUEL METERING SYSTEM

[75] Inventors: Günter Felger, Leonberg; Otto Glöckler, Renningen; Helmut Kauff, Schwieberdingen; Uwe Kiencke, Ludwigsburg; Heinrich Knapp; Herbert Stocker, both of Leonberg, all of Fed. Rep. of Germany

[73] Assignee: Robert Bosch GmbH, Stuttgart, Fed. Rep. of Germany

[21] Appl. No.: 294,877

[22] Filed: Aug. 21, 1981

[30] Foreign Application Priority Data

Sep. 25, 1980 [DE] Fed. Rep. of Germany ..... 3036107

[51] Int. Cl.[3] ..... F02D 5/00; F02M 7/12

[52] U.S. Cl. ..... 123/440; 123/480

[58] Field of Search ..... 123/440, 480, 589, 389; 60/276, 285

[56] References Cited

U.S. PATENT DOCUMENTS

| | | | |
|---|---|---|---|
| 4,278,060 | 7/1981 | Isobe et al. | 123/440 |
| 4,282,842 | 8/1981 | Sasayama | 123/480 |
| 4,290,400 | 9/1981 | Pomerantz | 123/440 |
| 4,291,659 | 9/1981 | Suzuki et al. | 123/440 |
| 4,313,412 | 2/1982 | Hosaka et al. | 123/480 |
| 4,319,327 | 3/1982 | Higashiyama et al. | 123/480 |
| 4,320,730 | 3/1982 | Takada et al. | 123/440 |
| 4,348,727 | 9/1982 | Kobayashi et al. | 123/480 |
| 4,354,238 | 10/1982 | Monaka et al. | 123/480 |

*Primary Examiner*—Raymond A. Nelli

*Attorney, Agent, or Firm*—Edwin E. Greigg

[57] ABSTRACT

A lambda regulating device is proposed for a fuel metering system in an internal combustion engine with externally supplied ignition. In addition to the regulation means which is already present, multiplicative and additive corrective variables are formed and are stored in non-transient memories. The regulating device enables an additive regulated shutoff of the additive lambda shift during idling and in the lower partial-load range, and it also enables regulation to a symmetrical distance on the part of the regulating manipulation from the limitation. The additive correction may be selected to be in accordance with rpm. Finally, the reference variables for the corrective value may be selected depending upon the air throughput in the intake tube of the engine. With a view to realization of the invention by means of a computer, individual flow diagrams relating to the mode of operation are given in the drawings.

7 Claims, 12 Drawing Figures

ṁL
ṁLS max
ṁLS
ṁL
t
WARM-UP

α
OPEN-LOOP CONTROL. OPERAT.
NO
YES
MARK = 0
NO
YES
ṁL ≥ ṁLS ?
NO
WARM-UP
YES
MARK = 0
YES
ṁLS := ṁLS-F10
MARK :=1
ṁLS := ṁL
NO
ṁLS > ṁLSmax²
YES
ṁLS := ṁLSmax
ω

REGULATING DEVICE FOR A FUEL METERING SYSTEM

BACKGROUND OF THE INVENTION

The invention is based on a regulating device for a fuel metering system of the general type for improved regulation of fuel metering. Such so-called lambda regulation systems have long been known, and theoretically they also may generally function satisfactorily. However, aging does occur in such systems, so that as the time in service of the system increases, it is no longer possible for the regulating system to establish an optimal mixture, and incorrect adaptations are accordingly made. Depending upon the load range, these effects of aging of the Lambda sensor and/or of the engine cause greater or lesser errors. Additive errors, for instance, are especially serious during idling and in the lower partial-load range, while multiplicative errors are particularly harmful or disturbing in high load ranges. It is true that the lambda regulation would compensate for these errors when they occur during steady state or normal operation; but during dynamic transitions, that is, transient operating states of the engine the lambda deviation and the duration of the compensation process are both increased as a consequence of aging. During actual vehicle operation, this results in an undesirable worsening of the exhaust-emission values.

OBJECT AND SUMMARY OF THE INVENTION

It is an object of the invention to provide an improved regulating device for a fuel metering system that enables the reduction of such errors to a minimum, and thus makes it possible to produce satisfactory exhaust-emission values over a long service life. In so doing, it is also assured that the entire regulating range of the device can be fully exploited. The superimposed adaptive regulative manipulations operate continuously; it is not a precondition that a stationary operational point be adhered to, but rather solely that vehicle operation is taking place, over a wide operational range. In consequence, errors in orienting the lambda signal to the open-loop control signals resulting from measurements taken at non-stationary points and from imprecise simulation of idle gas-flow time are eliminated.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
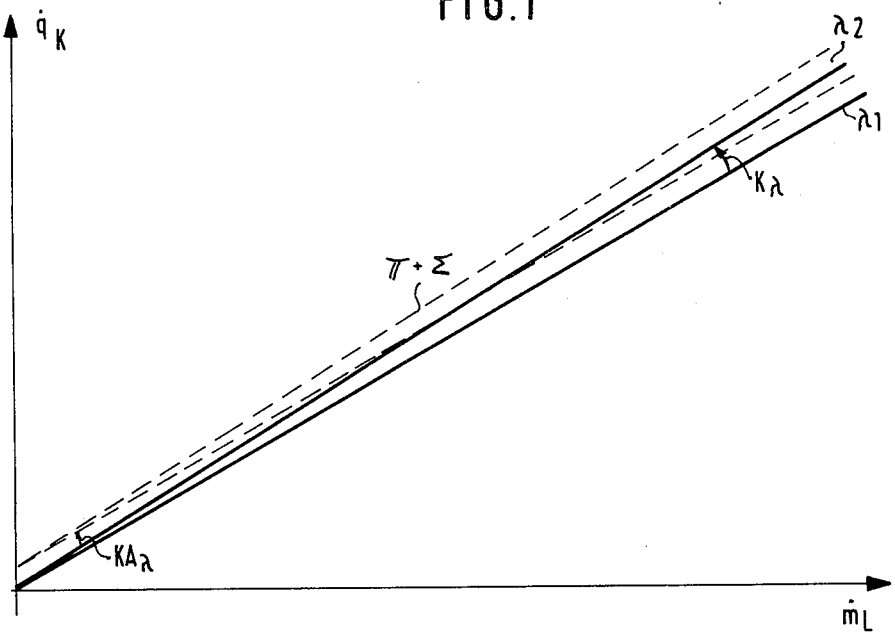
FIG. 1 shows a lambda characteristic curve with various possibilities for error.

Referring to the drawings, FIG. 1 shows a performance graph for air and fuel quantities in an internal combustion engine having externally supplied ignition. For a mixture which remains the same, the result is straight-line curves. An ideal mixture for a specific operational point of the engine is shown by the straight line λ 1 or lambda 1 through the origin, by way of example. When a motor vehicle is new, the basic setting for the mixture is made such that, as much as possible, the lambda regulation will have very little to compensate for. Experience teaches, however, that errors which are predominantly additive in nature occur as the result of engine aging, and these errors have the effect of parallel shifting the lambda 1 curve. An additive shift of this kind is illustrated in FIG. 1 by means of a dashed straight line parallel to the original straight line of lambda 1. It may be clearly seen that an error which has additive effects is particularly perceptible at small air quantities; that is, the greatest effect is during idling and in the low partial-load range. With large air quantities, and accordingly in ranges of high load, these additive errors have a relatively limited effect.

In contrast to the above, multiplicative errors in adaptation cause a rotation of the straight line 1 (original straight line λ 2 or lambda 2). These types of error are distinguished by a relative change which remains uniform over the entire operational range in comparison with the original basic setting.

These errors in adaptation are eliminated with the regulating device according to the invention, without large losses in reaction time in the case of changes which occur briefly.

It should be noted, of course, that regulation is a term used to describe a method by which one or more controlled variables (such as pressure, temperature, current, speed, power, and the like) are made to obey a command signal, whether constant or varying, according to a prescribed law, as a result of a measurement of the variable(s) in question and generally coupled in a closed-loop control system. Robert Bosch GmbH, *Technical Dictionary for Automatic Engineering,* p. 55 (1977).

Figure 2:
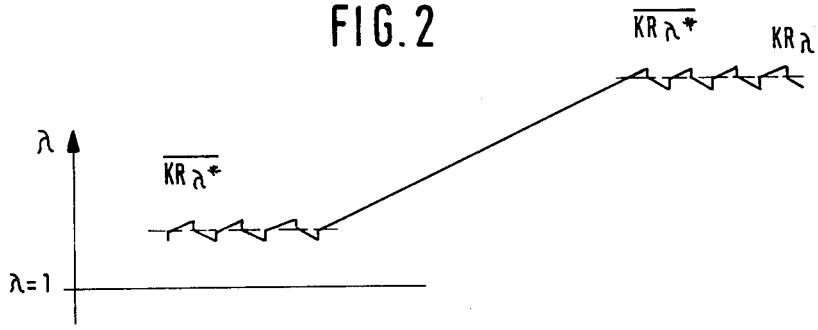
FIG. 2 is an illustration of the variation of the regulating manipulation during the transition to a new operational point of the engine.

FIG. 2 illustrates the change in the regulating manipulation of a lambda regulator during the transition to a new operational point. While the signal form shown on the left illustrates the conditions at the storage capacitor of the lambda regulator in the lower partial-load range by way of example, the corresponding signal image is shown at top right for the upper partial-load range. The straight connecting line indicates the transitional range. As a result of aging, the transitional range is enlarged. The times during which the lambda regulator is incorrectly adapted are thereby increased.

A lambda regulator further has a limited range for manipulation. When the engine has aged, or if there are interfering factors such as a widely varying altitude, the stoichiometric air-fuel ratio is kept stationary; that is, the regulator intervention or manipulation shifts to a new average value, out of the central position and in the direction of one of the two limitations. Since there is now only a short distance away from the limitation of the regulating manipulation, undesired peaks in exhaust emissions occur during the transition if the regulator arrives at the limitation too rapidly. The regulating device according to the invention enables a new basic setting to be established for the central position, and thus assures that the entire and symmetrical regulating range is available for use.

Figure 3:
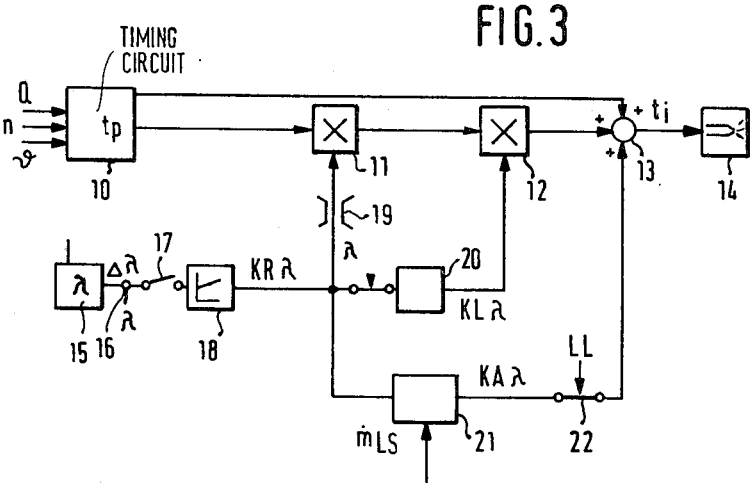
FIG. 3 is a schematic block circuit diagram of the regulating device according to the invention.

A schematic block circuit diagram of this regulating device is shown in FIG. 3. Its primary components are a timing element 10, two multiplier circuits 11 and 12 disposed in sequence, a subsequent adding element 13 and finally a magnetic valve 14. In the timing element 10, a signal tp of uniform pulse length is formed on the basis of the most important operating characteristics. This signal tp is multiplied with corrective values in the subsequent multiplier circuits 11, 12 and is finally corrected additively as well in the subsequent adding circuit 13. The output signal of this adding circuit 13 is then a signal pertaining to the desired injection time of the magnetic valve 14.

A lambda sensor 15 emits its signal via a comparison point 16 and a switch 17 to a lambda regulator 18. In the illustrated example, the lambda regulator 18 includes a PI regulator, and on its output side, via a limitation circuit 19, it controls the multiplication factor of the multiplier circuit 11.

This regulating manipulation has long been known in the prior art, and it therefore needs no detailed explanation. However, it is important that in the regulating device according to the invention the output signal of the regulator 18 is additionally used to regulate the regulating manipulation such as to provide a symmetrical distance from the limitation and an additive correction both in the lower load range and in the event of idling. The regulation of the symmetrical distance of the regulating manipulation from the limitation corresponds to an average-value shift; this is attained by means of a separate control circuit 20, which functions during the course of the lambda regulation and which, on its output side, influences the correction accomplished in the multiplier circuit 12. The additive correction in the lower load range, and especially during idling, is made possible by the correction circuit 21, whose output is connected with the adding circuit 13, for instance via an idling switch 22. In the illustrated example, the switch 22 is actuated only in the event of idling; thus, in this event, the additive correction is also carried out only during this operational state. The correction then remains in effect over the entire operational range.

Figure 4:
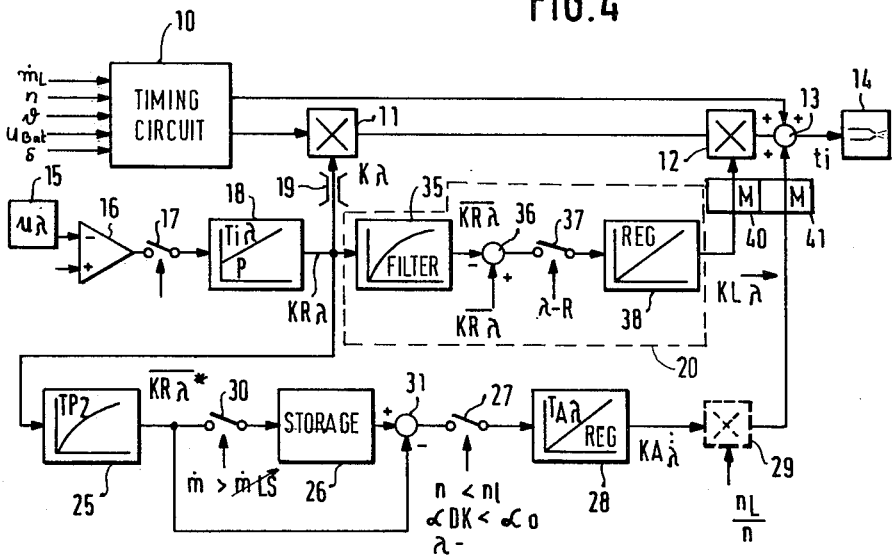
FIG. 4 is a more detailed block circuit diagram of the embodiment of the invention of FIG. 3.

FIG. 4 provides a block circuit diagram which is more detailed than that of FIG. 3. In this diagram, identical elements are provided with reference numerals corresponding to those of FIG. 3.

The switch 17 before the lambda regulator 18 is actuated in accordance with rpm and load. On the output side of the regulator 18, a regulator manipulation signal KR-lambda is available for use. This signal is smoothed in a low pass filter element 25 with a large time constant Tp2. The output signal of the low pass filter element 25 is $KR-\lambda^*$. At high air quantities which are larger than a threshold air quantity mLS, the smoothed value $\overline{KR-\lambda^*}$ is entered into a maintenance or storage element 26. This inclusion into the storage element 26 is not, however, effected at full load, because as a rule, the lambda regulation is not functioning at that time.

If the engine at some time thereafter then enters the idling or lower partial-load range, where the additive interference is known to have a severe effect, a switch 27 which corresponds to switch 22 of FIG. 3 is closed, and the additive basic idling setting is regulated, with the variable KA-lambda as the output signal of an I regulator 28, in such a manner that the regulating manipulation $\overline{KR-\lambda}$ corresponds precisely to the value previously stored in memory at the time where there was a large air quantity. In this fashion, an output signal of the regulator 18 is attained which is more or less constant in terms of its order of magnitude. Because of this fact, the lambda regulator 18 needs to be adjusted to a lesser degree during a transition to a different operational point, and consequently exhaust-emission peaks are reduced.

By means of a further correction circuit 29 following the regulator 18, the additive regulating manipulation KA-lambda can be shut off with the factor nL/n over the rpm, so as to reduce the additive effect still further at high rpm.

The operational state during which the maintenance or storage element 26 receives its information via a switch 30 from the low pass filter element 25 can furthermore be made selectable, by means of varying the control variable of this switch 30. There are various possibilities for attaining this end. It is efficacious for the response threshold of the switch 30 relating to the load state mLS to be fixed at a high level at first, after starting and warmup. Should the engine then not attain this operational state, the threshold is gradually lowered, so as to be able still to perform the adaptation. As soon as larger air quantities have been attained in steady operation, this threshold is then fixed at a higher level once again.

The comparison circuit 31 provided between the maintenance or storage element 26 and the switch 27 serves to ascertain the various deviations in the smoothed output signal of the regulator 18 as compared with the stored value in the memory or storage 26; these deviations are then compensated for by the subsequent I regulator 28.

The problem discussed above of the excessively close approach to the limitation which is caused by the shift of the regulating manipulation out of the central position is solved by means of the corrective variable KL-lambda, which functions multiplicatively. It gradually carries the average value $\overline{KR-\lambda}$ back, between the limitations, to the desired value $\overline{KR\lambda\ soll}$. This is attained by means of a low-pass filter 35 in the center-shift circuit 20. The low-pass filter 35 has a large time constant; it is followed by a comparison circuit 36 for a comparison between set-point and actual values and finally by a switch 37, which is closed only during the lambda regulation, and an I regulator 38. The output signal of this I regulator 38 then acts as the "shift signal" KL-lambda and the input signal of the multiplier circuit 12.

In order that the individual corrective values will not always have to be newly established after the starting of the engine, they are stored in non-transient memories or "non-volatile" memories 40, 41, which do not lose their contents after the engine is shut off, following the respective I regulators 38 and 28.

Figure 5:
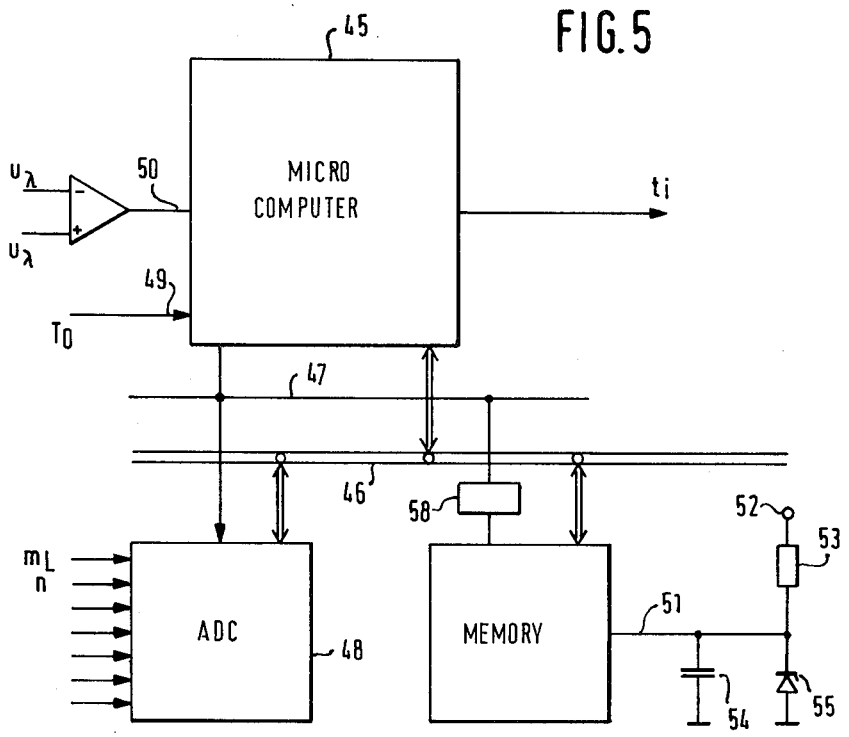
FIG. 5 shows one block schematic diagram of an embodiment of the regulating device according to the invention.

FIG. 5 illustrates the basic realization of injection control, in an internal combustion engine with externally supplied ignition, with the aid of a microcomputer. The fundamental arrangement is known per se. It includes a microcomputer 45, for instance, an Intel 8048, a data bus 46, a control bus 47 and an analog-to-digital (AD) converter 48. By way of this AD converter 48 having a multiplexer, the various analog signals are converted and made available via the data bus for use by the computer. By way of a computer input 49, the rpm signal, which is utilized for rpm detection and arrives from the ignition, effects an "interrupt" mode with which rpm-dependent processes are controlled; an example of this is the evaluation of the counter status of the timer. At the same time, a lambda regulation program can also be performed via an input 50, which is indicated in basic fashion. With other rpm signals or program variants, the lambda regulation may possibly be provided with a higher scanning rate. Since the mode of operation of a regulating device according to the invention is a matter of slow processes, it is sufficient if the performance of a program is effected only once or several times per revolution.

Since the two corrective variables KL-lambda and KA-lambda must be stored in memory in a non-transient manner, a non-transient read-write memory (e.g., NS 74 C373) is present in the subject of FIG. 5. Via a specialized voltage supply line 51, this component continuously receives the energy which it requires for storing information in memory from a battery voltage terminal 52 which cannot be shut off. In order to stabilize this voltage, a resistor 53 is also disposed in this line, as well as a parallel circuit comprising a capacitor 54 and a Zener diode 55 leading from the line to ground. In the state of rest, the uptake of current into the memory is low, so that there is only a small load on the vehicle battery.

The coupling of the non-transient memory to the computer 45 is effected via the same data bus 46 as is the case with the AD converter 48. Solely with the open-loop control lines does a supplementary circuit 58 assure that writing commands are executed only at specified times.

Figure 6:
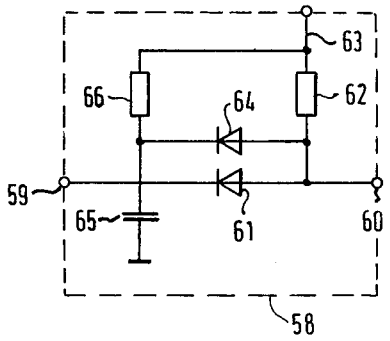
FIG. 6 is a detail of the invention of FIG. 5.

One example of a supplementary circuit 58 of this kind is given in FIG. 6. Here, a diode 61 is located between an input terminal 59 and an output terminal 60. The output 60 is further connected via a resistor 62 with a positive-voltage line 63, and it is connected to ground via a diode 64 and a capacitor 65 disposed in series with this diode. The resistor 62 and the diode 64 are also bridged by a resistor 66.

This circuit arrangement assures that a writing command at the input 59 can be switched through only when there is a constant voltage on the positive line 63; in all other cases, the output 60 is at more or less zero potential.

The regulating manipulations KA-lambda and KL-lambda have only a limited range of variation; because of this, it is not necessary to store the full value in memory, but rather only the difference between it and a constant minimal value. This reduces the number of required places in memory; in the exemplary embodiment, this is reduced to a total of 8 bits.

Figure 7:
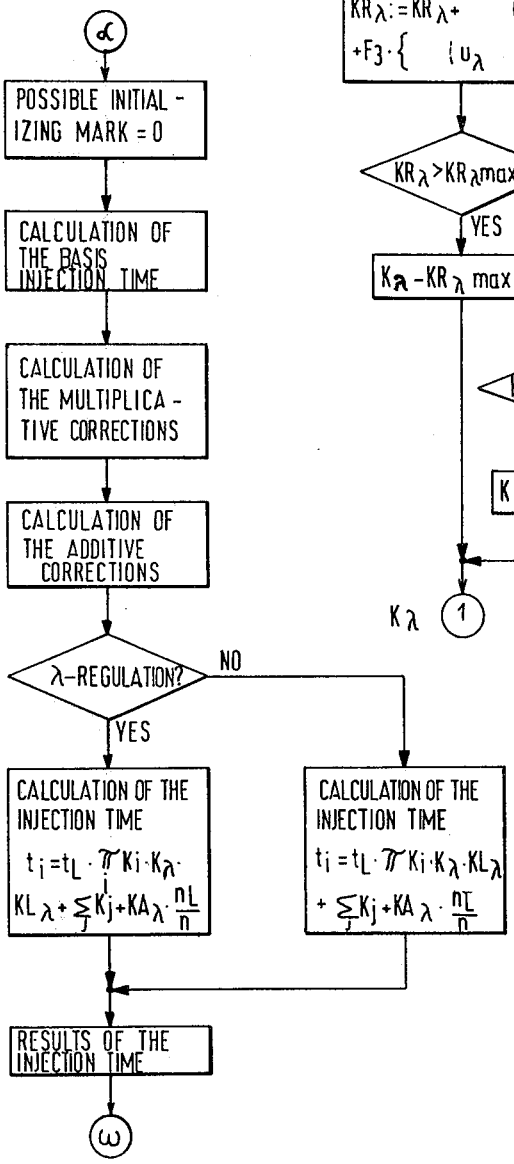
FIGS. 7 and 8*a* to 8*c* are flow diagrams for the computer-controlled embodiment of the invention of FIG. 4.

Flow diagrams for the computer program are given in FIGS. 7 and 8. With these programs, the computer of the invention of FIG. 5 is operated in a manner appropriate to the apparatus of FIG. 4.

FIG. 7 illustrates the computation of the injection time, taking the corrections into consideration. The sequence of the computation is clear from the diagram: basic injection time, multiplicative corrections, additive corrections; this is effected in accordance with the topmost line of the subject of FIG. 3, and it encompasses a lambda regulation as well. In the case where the lambda regulation is switched off, such as during warm-up or at full load, the K-lambda factor equals a constant value, in contrast to the variable values which it assumes while lambda regulation is being performed.

Figure 8A:
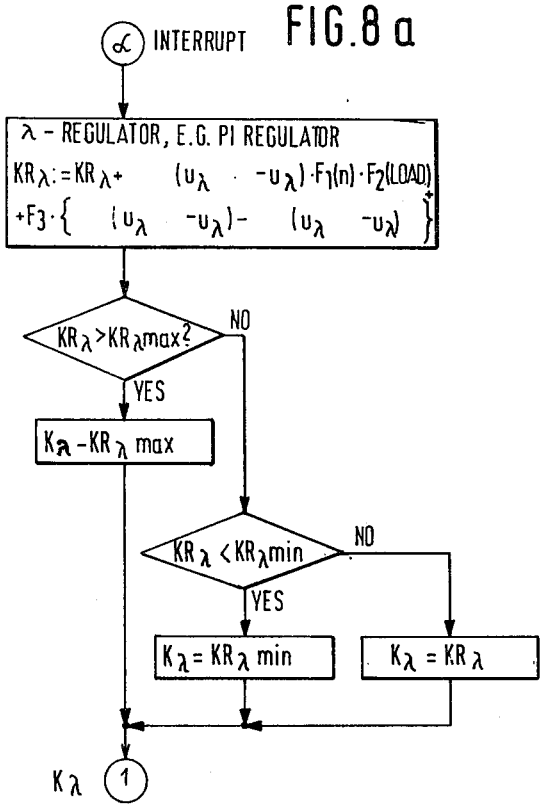
Figure 8B:
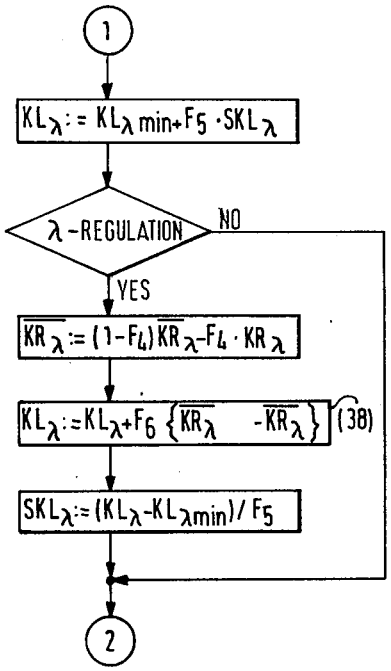
Figure 8C:
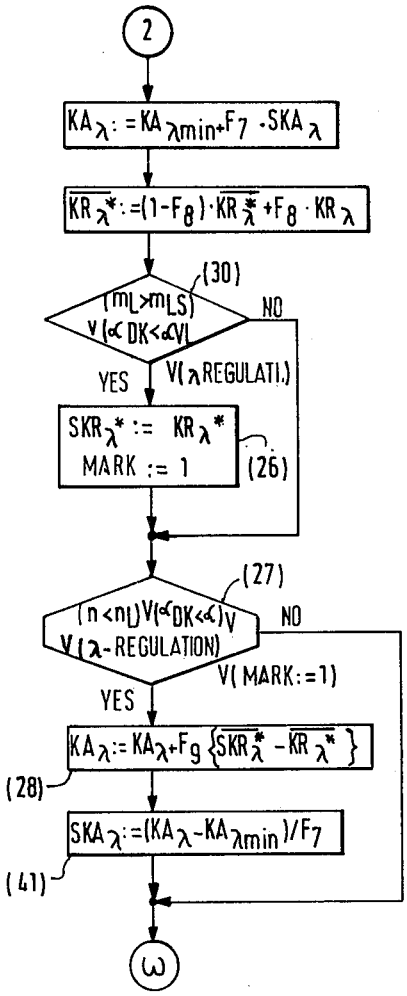

FIGS. 8*a*, 8*b* and 8*c*, in the form of a flow diagram, illustrate one example for computing the lambda regulation value. The value KR-lambda is produced on the basis of a PI algorithm, in which the integration time constant is determined by the frequency of the program interrogation and by the factors F1 and F2; the height of the proportional jump is determined by the factor F3. In this respect, see also the various inscriptions in FIGS. 3 and 4.

The effectual regulating manipulation K-lambda in the multiplier circuit 11 of FIG. 4 results from an interrogation as to the limitation. In the case of open-loop control, the fixed factor K-lambda-control is used (see FIG. 7, bottom right).

The manipulated variable KR-lambda, which effects a multiplicative manipulation or intervention, is subsequently regulated into the central position between the limitations, as is shown in FIG. 8*b*. Because only the difference between SKL-lambda and the minimum value KL-lambda min is stored in memory, in order to reduce the expenditure for memory capacity, the first computation is for the regulating manipulation KL-lambda. This value is also capable, in the case of operation with open-loop control, of correcting the basic adaptation of the injection time.

In the case of closed-loop control or regulated operation, the manipulated variable KR-lambda of the actual lambda regulation is filtered. The filtering time constant amounts to approximately TPI T-Abtast$\approx$(1−F4)/F4 or TPI$\approx$T-Scan (1−F4)/F4. Because the time constant of the subsequent integral regulator 38 is large (determined by factor F6), the filtering which precedes it may also be eliminated if desired. After computation of the new manipulated variable KL-lambda, only the difference between it an the minimum value is stored in the non-transient memory in order to reduce expenses.

FIG. 8*c* illustrates the additive subsequent regulation of the manipulated variable KR-lambda to identical values at various operational points. The KA-lambda, like the KL-lambda, is stored in memory solely in the form of the difference SKA-lambda from the minimum value KA-lambda min. For this reason, KA-lambda is computed first. Next, filtering of the manipulated variable KR-lambda is effected with the time constants TP2$\approx$T-Abtast (1−F8)/F8 or TP2$\approx$T-Scan (1−F8)/F8. In the case of large air quantities, the filtered regulating manipulation $\overline{KR-\lambda^*}$ is stored in the memory 26 of FIG. 4 in the form of the set-point value $\overline{SKR-\lambda^*}$.

In the case of small air throughputs in the intake tube, that is, at low load, the variable KA-lambda is altered via the integral regulator 38 in such a manner that the actual lambda manipulation KR-lambda on average assumes the value stored when the throughput quantities are large.

The output variable KA-lambda may be evaluated in accordance with rpm via the multiplier circuit 29 as shown in FIG. 4. In this respect, see also the final expression in the respective parallel blocks of FIG. 7.

Figure 9:
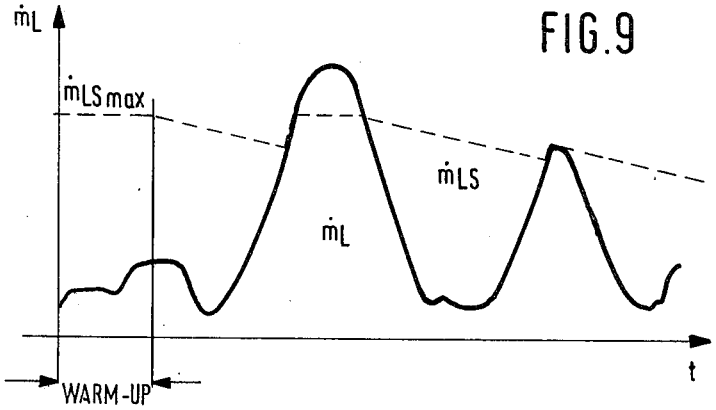
FIG. 9, in an air-flow rate diagram plotted over time, discloses the intended variation in a control manipulation made in the regulating device in accordance with the air flow rate.
Figure 10:
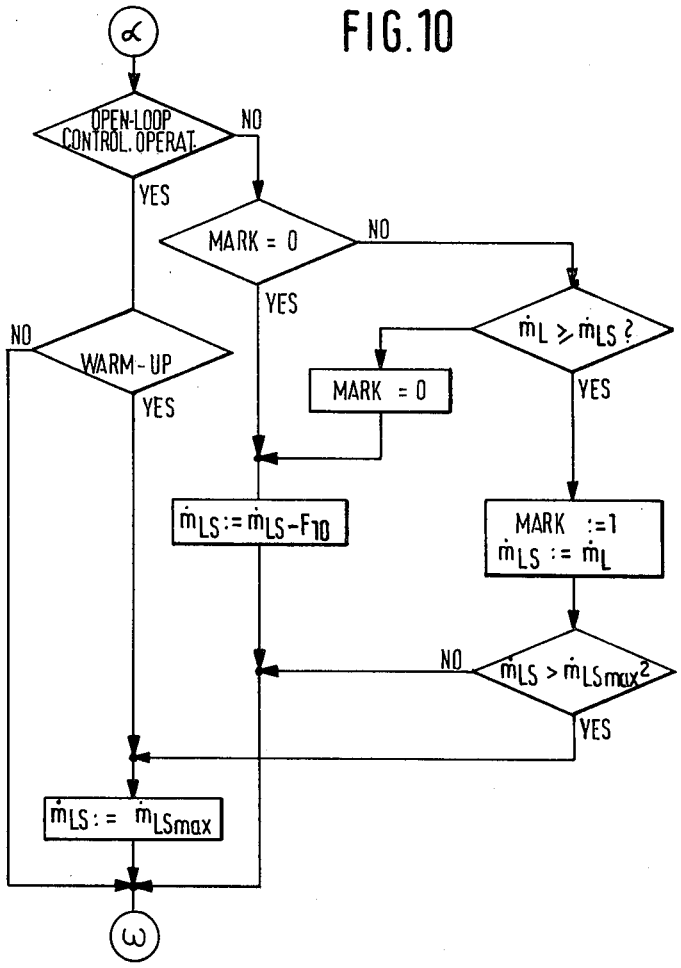
FIG. 10 illustrates a preferred embodiment of a control manipulation system in the form of a flow diagram.

In the discussion of the subject of FIG. 4, it has already been noted that the actuation of the switch 30 may be effected in accordance with the air throughput. FIG. 9 illustrates the location of 'the air-quantity threshold value' $\dot{m}LS$. During operation under open-loop control starting and warm-up, the threshold is set at a 'maximal value', $\dot{m}LS_{max}$. The flow diagram for the corresponding part of the program is shown in FIG. 10. From this, it may be clearly seen that as long as a set mark is equal to zero, the threshold has not yet been attained, and a regulated shutoff accordingly occurs. The steepness of inclination of this process is determined by the factor F10. The mark is set at zero whenever the air quantity again drops below the threshold $\dot{m}LS$.

As soon as the air quantity increases above the threshold $\dot{m}LS$, the threshold is increased along with it, but at the most only as far as the maximal value $\dot{m}LSmax$.

In summary, the following advantages are attained with the regulating device described above and shown in the drawings:

(a) The basic initial setting of the control device may be eliminated, because this function is taken over by the described lambda control, (b) The basic initial setting is stored in memory even when the engine is in a state of rest. It is effective even in the case of operation under open-loop control. Thus the aging of the engine is compensated for even during operation under open-loop control.

(c) The tolerance of the control device does not need to be compensated for, (d) An adaptation of the lambda manipulations is provided for the various operational points. During a dynamic transition to a new operational point, the manipulation therefore varies only minimally, which causes a reduction in the exhaust emission peaks. The actual lambda regulator accordingly needs to perform corrections less frequently, (e) A so-called altitude error is corrected without disadvantageous effects on the lambda regulation, such as a shift in the limitation, and (f) The available range of the lambda regulation before reaching the limitation can be reduced. The remaining regulatory range can then be more precisely distinguished with a predetermined computer word length.

Adaptive regulation is effected continuously, if the engine is operating within the permissible operational range. A limitation to stationary operational points, which are, in practice, hardly ever available for use, may therefore be omitted. Furthermore, errors caused by a deficiency in orientation of the lambda measurement signal to the control signals can be prevented by the provision of dead time on the part of the computer.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A regulating device for a fuel metering system in an internal combustion engine comprising, a signal generator circuit for generating a fuel metering signal, an $O_2$ sensor coupled with a regulator for exerting a supplementary influence upon said metering signal, said regulator producing a regulating corrective signal, at least one means for smoothing said corrective signal, memory means for storing the output of one of said at least one smoothing means in dependence upon operating parameters of the engine, and subsequent regulator means responsive to said at least one smoothing means receiving said corrective signal, and means for influencing said metering signal additively and multiplicatively in dependence on engine parameters, wherein (a) said means for additively influencing said metering signal is controlled via said subsequent regulator means by one of said at least one smoothing means and by said memory means, and (b) said means for multiplicatively influencing said metering signal is controlled via said subsequent regulator means by one of said at least one smoothing means.

2. A regulating device as defined by claim 1, wherein the regulating manipulation signal, the central position of the regulating range is regulated by means of exerting multiplicative influence.

3. A regulating device as defined by claim 1, characterized in that in the case of idling and in the lower partial-load range, an additively functioning corrective value is regulated such that the regulating signal has approximately the same value as in the case of high air throughput quantities, so that during a dynamic transition the necessary adaptation of the regulating signal is lessened.

4. A regulating device as defined by claim 3, characterized in that the regulating signal is averaged and the value obtained in the upper load range is stored in said memory means, the difference between the stored value and the instantaneous value is formed and, in the lower load range, this differential value is supplied to said subsequent regulator means.

5. A regulating device as defined by claim 4, characterized in that the load state above which the averaged value is stored, is variable.

6. A regulating device as defined by claim 4, characterized in that one of the output values of the subsequent regulator means is capable of being influenced in accordance with rpm.

7. A regulating device as defined by claim 4, characterized in that the respective outputs of said subsequent regulator means are capable of being stored in nonvolatile memories.

* * * * *